United States Patent [19]

Sadanobu et al.

[11] Patent Number: 5,047,292

[45] Date of Patent: Sep. 10, 1991

[54] PITCH-BASED CARBON FIBER AND PROCESS FOR PREPARATION THEREOF

[75] Inventors: Jiro Sadanobu; Akihiro Ohba, both of Iwakuni; Tsutomu Nakamura, Yamaguchi, all of Japan

[73] Assignee: Teijin Limited, Osaka, Japan

[21] Appl. No.: 281,245

[22] Filed: Dec. 7, 1988

[30] Foreign Application Priority Data

Jun. 10, 1988 [JP] Japan ..... 63-141670

[51] Int. Cl.[5] ..... B32B 9/00

[52] U.S. Cl. ..... 428/367; 428/364; 428/399; 428/397; 423/447.1; 423/447.2; 423/447.4; 423/447.6

[58] Field of Search ..... 428/408, 364, 367, 397, 428/399; 423/447.1, 447.2, 447.6

[56] References Cited

U.S. PATENT DOCUMENTS

| | | | |
|---|---|---|---|
| 4,504,454 | 3/1985 | Riggs | 423/447.2 |
| 4,590,055 | 5/1986 | Yamada et al. . | |
| 4,628,001 | 12/1986 | Sasaki et al. . | |
| 4,818,612 | 4/1989 | Hara | 428/367 |

FOREIGN PATENT DOCUMENTS

| | | |
|---|---|---|
| 0166388 | 1/1986 | European Pat. Off. . |
| 0169023 | 1/1986 | European Pat. Off. . |
| 163423 | 3/1983 | Japan . |
| 163424 | 3/1983 | Japan . |
| 177222 | 1/1986 | Japan . |
| 113827 | 5/1986 | Japan . |
| 75119 | 9/1986 | Japan . |
| 41320 | 2/1987 | Japan . |
| 8403722 | 9/1984 | PCT Int'l Appl. . |
| 1496678 | 12/1977 | United Kingdom . |
| 2131781 | 6/1984 | United Kingdom . |

*Primary Examiner*—George F. Lesmes
*Assistant Examiner*—Jill M. Gray
*Attorney, Agent, or Firm*—Burgess, Ryan & Wayne

[57] ABSTRACT

A pitch-based carbon fiber having a microstructure consisting of strip-like structural units extended in the longitudinal direction of the fiber, wherein the fractal dimension D of the arrangement of the strip-like structural units in the cross-section of the fiber has a fractal structure satisfying the requirement of the following formula (2) relatively to the observation scale r satisfying the requirement of the following formula (1) with respect to the cross-section of the fiber:

$$E/2.5 > r > E/25 \quad (1)$$

$$2.0 > D > 1.05 \quad (2)$$

wherein E in the formula (1) stands for a smallest principal radius of gyration of cross-sectional area of the cross-section of the fiber.

6 Claims, 2 Drawing Sheets

PITCH-BASED CARBON FIBER AND PROCESS FOR PREPARATION THEREOF

BACKGROUND OF THE INVENTION

1. Field of the Invention

The present invention relates to a carbon fiber having a high strength and a high elastic modulus, which is prepared from an optically anisotropic pitch as the starting material, and a process for the preparation of this carbon fiber. More particularly, the present invention relates to a pitch-based carbon fiber having a microstructure consisting of strip-like structural units, in which the strength and elastic modulus are highly improved because the configuration of the strip-like structural units in the cross-section of the fiber takes a fractal structure, and a process for preparing the fiber on an industrial scale.

2 Description of the Related Art

Initially, carbon fibers were prepared by using rayon as the starting material, but at present, carbon fibers are occupied by PAN carbon fibers prepared from polyacrylonitrile (PAN) fibers as the starting material and pitch-based carbon fibers prepared from coal or petroleum pitch as the starting material from the viewpoints of characteristics and the economical viewpoint. Especially, the technique of preparing a carbon fiber having a high performance grade from pitch as the starting material attracts attention because this technique is excellent from the economic viewpoint. For example, it is known that a carbon fiber obtained by melt-spinning an optically anisotropic pitch, rendering the spun fiber infusible and carbonizing the fiber has higher strength and higher elastic modulus than those of conventional pitch-based carbon fibers (see Japanese Examined Patent Publication No. 54-1810 or U.K. Patent No. 1,496,678).

However, in case of pitch-based carbon fibers, cracks are formed along the direction of the fiber axis at the preparation steps, and even if cracks are not formed, the fibers are very brittle, and it is difficult to obtain a carbon fiber having improved strength and elastic modulus.

Under this background, trials have been made to improve the physical properties of carbon fibers by controlling the cross-sectional structure of the fibers. The cross-sectional structure heretofore discussed is the selective orientation state on the carbon layer face presumed by observation of the cross-section of the fiber just after melt spinning or after carbonization or graphitization by a polarization microscope or scanning electron microscope. In general, the structure in which carbon layer faces are radially arranged in the cross-section of the fiber is called "the radial structure", the structure in which carbon layer faces are concentrically arranged is called "the onion structure", and the structure in which the selective orientation is obscure is called "the random structure".

It is known that of these structures, it is the radial structure that causes cracking, and therefore, the preparation technique of manifesting a cross-sectional structure other than the radial structure has been vigorously sought for.

For example, Japanese Unexamined Patent Publication No. 59-53717, Japanese Unexamined Patent Publication No. 59-76925, Japanese Unexamined Patent Publication No. 59-168127 propose the onion or random structure, Japanese Unexamined Patent Publication No. 59-168424 proposes the random structure, and Japanese Unexamined Patent Publication No. 59-163423 proposes the distorted radial structure or the random structure. Each of these structures is formed by adopting specific spinning conditions or using a spinning nozzle having a specific shape. Furthermore, Japanese Unexamined Patent Publication No. 61-186520 and Japanese Unexamined Patent Publication No. 61-12919 teach that a cross-sectional structure other than the radial structure is formed by placing a filler just above the spinning nozzle, and Japanese Unexamined Patent Publication No. 62-177222 and Japanese 63-75119 teach that a cross-sectional structure other than the radial structure is formed by arranging a stationary or dynamic stirring apparatus on the spinning nozzle.

However, these processes commonly involve the following two problems.

(1) The reproducibility of manifestation of the desired cross-sectional structure is poor, and prevention of formation of cracks is not complete.

(2) Even if the desired cross-sectional structure is manifested and cracks are not formed along the fiber axis, the brittleness of the fiber is not eliminated.

The technique of solving these problems and stably providing a high-strength pitch-based carbon fiber having a strength of above 400 kg/mm$^2$, that is, a high strength comparable to that of the PAN type carbon fiber was not completed.

As the means for solving these problems effectively, Sasaki et al proposes in U.S. Pat. No. 4,628,001 a process in which a leafy structure is formed by using a non-circular spinning nozzle having a specific shape. According to this process, formation of cracks along the direction of the fiber axis can be completely prevented and a tensile strength exceeding 400 kg/mm$^2$ is realized Furthermore, Japanese Unexamined Patent Publication No. 61-113827 proposes a spinning process using a non-circular spinning nozzle having a specific shape, in which a dividing pitch flow path controlling element is arranged on the nozzle. Even according to these processes, however, the strength of the obtained carbon fiber tends to decrease with increase of the Young's modulus, and it is difficult to maintain a tensile strength exceeding 500 kg/mm$^2$ when the Young's modulus is higher than 30 T/mm$^2$. Moreover, even in the case where increase of the Young's modulus is not especially aimed, the problem of the low elongation considered to be an inherent problem of carbon fibers is not solved, and a carbon fiber having a strength exceeding 500 kg/cm$^2$ and simultaneously, an elongation higher than 2.5% cannot be realized. Furthermore, the pitch-based carbon fiber prepared according to this process has inevitably a non-circular cross-section, and the process is defective in that an optional cross-sectional shape cannot be selected.

SUMMARY OF THE INVENTION

It is the primary object of the present invention to overcome the above-mentioned defects of the conventional pitch-based carbon fibers and provide a high-strength pitch-based carbon fiber prepared from an optically anisotropic pitch as the starting material and a process for the preparation of this carbon fiber.

This object can be attained by the pitch-based carbon fiber of the present invention. More specifically, in accordance with the present invention, there is provided a pitch-based carbon fiber having a microstructure consisting of strip-like structural units extended in the longitudinal direction of the fiber, wherein the fractal dimension D of the arrangement of the strip-like structural units in the cross-section of the fiber has a fractal structure satisfying the requirement of the following formula (2) relatively to the observation scale r satisfying the requirement of the following formula (1) with respect to the cross-section of the fiber:

$$E/2.5 > r > E/25 \quad (1)$$

$$2.0 > D > 1.05 \quad (2)$$

wherein E in the formula (1) stands for the smallest radius of gyration of cross-section area of the fiber.

DESCRIPTION OF THE PREFERRED EMBODIMENTS

Figure 1:
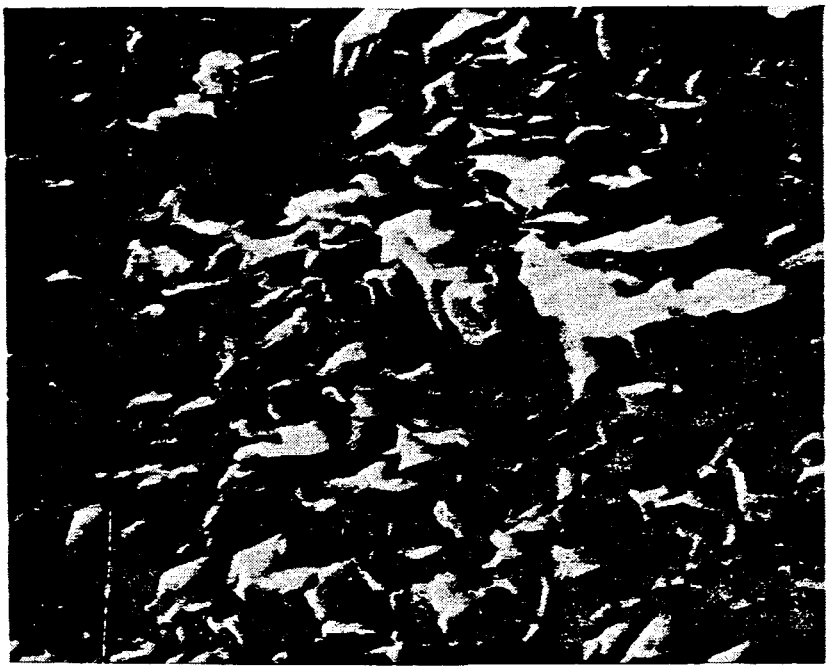
FIG. 1 is a scanning electron microscope photograph of the cross-section of a pitch-based carbon fiber having a fractal structure according to the present invention, which shows an example of the microstructure of the carbon fiber.

By the microstructure of the fiber referred to herein is meant an image obtained by observing the cross-section of the fiber by using a scanning electron microscope, and the resolving power of the measurement apparatus and measurement conditions adopted for the observation of this image, that is, the shortest distance between discernible two points in the image, should be smaller than 1/25 of the smallest radius of gyration of the fiber cross-section.

The configuration of the strip-like structural units (lamellae) extended in the longitudinal direction of the fiber, which constitute the microstructure of the fiber, in the cross-section of the fiber cannot be expressed by a simple line or curvature, and the fractal structure referred to herein is the apparently mathematical self-similality defining this configuration. The self-similality, that is, the idea of the fractal, is the idea now broadly used in the field of science and a complicated geometrical configuration can be expressed by the parameter of the fractal dimension, as shown in the book written by Mandelbrot, the advocate of this idea (The Fractal Geometry of Science, Freeman, San Francisco, 1984).. There are many methods for determining the fractal dimension of an optional object, but in the instant specification, the fractal dimension of the structural units in the cross-section of the fiber is defined according to the following process.

The structural units of the pitch-based carbon fiber of the present invention have a strip-like shape extended in the longitudinal direction of the fiber and have a one-dimensional continuity in the cross-section of the fiber. Now, approximation of the configuration the structural units in the direction of the continuity in the cross-section of the fiber by aggregation of segments having a certain length r is considered. The shape of the structural units of the pitch-based carbon fiber of the present invention in the cross-section of the fiber is substantially defined by a curve. In order to approximate this curve by segments, at first, an optional portion where the structural units are continuous is taken out from the cross-section of the fiber under a scanning electron microscope, one end of this portion is regarded as the starting point, a circle having a radius r is drawn with this point as the center, a straight line is drawn between the starting point and the point where the circle first intersects the structural unit, and the foregoing operation is repeated while regarding this intersection point as the new starting point. The total number of segments necessary for approximating the entire length of the now considered portion of the structural units by the segments having the length r is designated as N(r). In the case where when the length r of the segments is changed, N(r) depends on r and changes in proportion to the power exponent r as indicated by the following formula, the exponent D of r in the formula is defined as the fractal dimension of the structural units:

$$N(r) = A \times r^{-D} \quad (8)$$

where A is a constant.

The fractal dimension need not be constant with respect to all of r, and in the case where D depends on r, the dimension is defined as the gradient of the tangent on certain r obtained when N(r) and r are logarithmically plotted. Supposing that the fractal dimension to certain r is D(r), this definition is expressed by the following formula (9):

$$D(r) = -d(\log N(r))/d(\log r) \quad (9)$$

wherein d is the differential symbol.

The pitch-based carbon fiber of the present invention should have a fractal structure in which D(r) relative to r in the range of from 1/2.5 of the value of E defined above to 1/25 of said radius has at least 1.05 of the fractal dimension. It is especially preferred that D(r) be at least 1.1 of the fractal dimension. The upper limit of D(r) is not particularly critical, but from the theory of the fractal mathematics, it is obvious that D(r) does not exceed 2.0.

The value E of the fiber is determined according to the following formulae (10) through (14):

$$E = (I/A)^{\frac{1}{2}} \quad (10)$$

$$I = \tfrac{1}{2}(Ix + Iy) - \tfrac{1}{2}\{(Ix - Iy)^2 + 4Jxy^2\}^{\frac{1}{2}} \quad (11)$$

$$Ix = \int_A y^2 dA \quad (12)$$

$$Iy = \int_A x^2 dA \quad (13)$$

$$Jxy = \int_A xy dA \quad (14)$$

wherein Ix, Iy and Jxy stand for the second moment of relative to the axes x and y of a figure formed by the cross-section of the fiber when in a plane figure formed by the cross-section of the fiber, optional orthogonal axes Oxy are taken with the centroid of the figure being as the origin, and the product of inertia, respectively, I stands for the smallest principal second moment of the cross-section of the fiber, and A stands for the cross-sectional area.

Integration of each of the formula (12), (13) and (14) is performed over the entire area of the cross-section of the fiber.

In the case where the cross-sectional shape is of a true circle, the value E is equal to ½ of the radius of said circle.

The specific method for the measurement of the fractal dimension will be described in detail herein after.

We found that it is the shape of the microstructure in the order of 1/10 to 1/100 of the diameter of the fiber that governs the mechanical characteristics of the fiber, especially the mechanical strength of the fiber, and if the shape has a high dimensional fractal structure, formation of cracks is completely prevented and the fiber is very tough. Accordingly, the defects of the conventional pitch-based carbon fibers can be overcome by the fiber of the present invention.

By the electron beam analysis, it can be proved that the pitch-based carbon fiber of the present invention consists of grain units where carbon hexagonal net planes constitute strip-like structural units and the hexagonal carbon net planes are arranged on the average in parallel to the strip-like structural units. Accordingly, the fractal structure is such that the continuous carbon hexagonal net planes have a complicated orientation distribution indicated by the dimension of the fractal structure. Therefore, formation of cracks by the contraction of carbon layer planes at the molding step, which is the problem of the conventional pitch-based carbon fibers, can be completely controlled, and furthermore, the resistance to propagation of microcracks formed in the fiber is drastically increased and a fiber having a very high strength can be realized.

As the means for inhibiting the propagation of microcracks, for example, Japanese Unexamined Patent Publication No. 62-41320 proposes a carbon fiber in which the carbon layer structure has a fold radius of 15 to 200 Å. However, it is difficult to control breaking, which is a catastrophic phenomenon, only by such a microstructure, and in fact, the strength of the fiber realized by this proposal is 340 kg/mm$^2$ at highest. Moreover, only a very local structure can be observed through a transmission electron microscope image, and the average structure of the entire fiber cannot be known. Furthermore, it is obvious that a macroscopic characteristic such as the strength can hardly be determined or discussed based on the analysis of dark visual image in which many and large errors are caused in the preparation of a measurement sample and in the measurement by the microscope.

The fractal structure of the present invention is much more complicated than the structure of the above proposal defined by a simple curvature, and the fiber of the present invention is characterized in that propagation or growth of microcracks is controlled because of this complicated structure. Accordingly, it is possible that D of the formula (2) will be established even in the case where r is outside the range defined by the formula (1). However, the structure relative to r smaller than E/25 has no substantial influence on the growth of microcracks in the fiber to microcracks, and the structure relative to r larger than E/2.5 has influences only on microcracks which have already grown to a fatal size. Therefore, both the structures are irrelevant to the strength and toughness of the fiber. Even in the case where the structure is observed on a scale larger than E/2.5, that is, the resolving power of the observation is lower than E/2.5, and the structure is recognized as a known structure such as a radial structure, an onion structure, a random structure or a combination thereof, if it is confirmed by the observation at a higher resolving power that D satisfies the requirement of the formula (2) within the range of r defined by the formula (1), the fiber is included within the scope of the pitch-based carbon fiber having a fractal structure according to the present invention. A pitch-based carbon fiber having a structure which is highly complicated so that the structure is changed if the resolving power of the observation is changed and which can be specified by the idea of fractal at least within a certain range of the observation scale has not been known at all, and the structure of the fiber of the present invention is novel.

Figure 2:
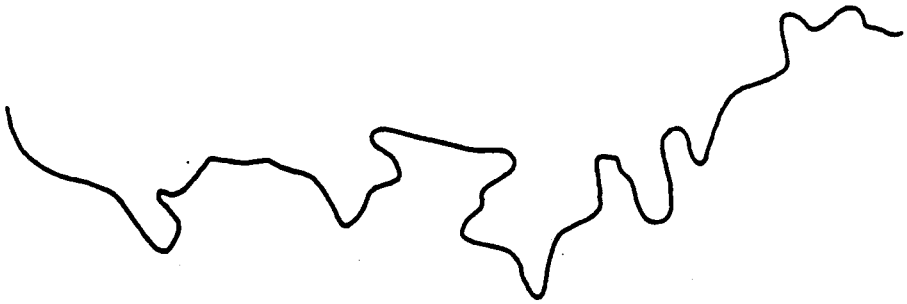
FIG. 2 is a curve showing an example of the fold state of the structural units of the pitch-based carbon fiber shown in FIG. 1.

FIG. 1 is a scanning electron microscope photograph of the cross-section of the fiber, which illustrates the microstructure of the pitch-based carbon fiber having a fractal structure according to the present invention. From FIG. 1, it is seen that in the pitch type carbon fiber of the present invention, strip-like structural units (lamellae) have a complicated fold structure. FIG. 2 illustrates an example of the fold state of the structural units in the cross-section of the carbon fiber shown in FIG. 1, and the fractal dimension D of the structural units is 1.22.

The outer configuration of the cross-section of the pitch-based carbon fiber having a fractal structure according to the present invention is not particularly critical, and the fiber can take an optional outer configuration.

The pitch-based carbon fiber of the present invention having a specific fractal structure as mentioned above has a strength of at least 500 kg/mm$^2$.

In the pitch-based carbon fiber of the present invention, the Young's modulus can be changed within a broad range by adjusting the carbonization temperature, but in the pitch type carbon fiber having the specific fractal structure according to the present invention, even if the Young's modulus is 30 T/mm$^2$ or higher, the strength is not reduced but maintained at a level of at least 500 kg/mm$^2$. As shown in the examples given hereinafter, a Young's modulus exceeding 50 T/mm$^2$ can be realized simultaneously with a strength exceeding 600 kg/mm$^2$.

In the pitch-based carbon fiber having the specific fractal structure according to the present invention, if the invariant $<\eta^2>$ (mole electron$^2$/cm$^6$) and the correlation length $a_c$ (521 ) satisfy the requirements of the following formulae (3) and (4), the strength and elongation are increased, and a strength of at least 500 kg/mm$^2$ and an elongation of at least 2.5% can be simultaneously attained:

$$<\eta^2> <0.1 \text{ mole electron}^2/\text{cm}^6 \quad \text{(b 3)}$$

$$a_c<10 \text{ Å} \quad (4)$$

The invariant $<\eta^2>$ and correlation length $a_c$ are parameters determined by the X-ray small angle scattering measurement, and the determination methods will be described in detail hereinafter.

The X-ray small angle scattering measurement is to measure the fluctuation of the electron density in a substance, and $<\eta^2>$ is proportional to the square of the electron density of the system and $a_c$ corresponds to the half value width of the correlation function to the electron density distribution and indicates the magnitude of the fluctuation of the electron density. In case of the carbon fiber of the present invention, it is considered that microvoids present in the grain boundary in the fiber exert a main scattering function of the X-ray small angle scattering. In case of an ideal system, that is, a complete two-phase system consisting of microvoids and the substance of the fiber, $<\eta^2>$ is proportional to the total volume ratio of the microvoids and $a_c$ indicates the average dimension of the microvoids if the quantity of the microvoids is sufficiently small. Namely, decrease of $<\eta^2>$ indicates that the system becomes more homogeneous, and decrease of ac indicates that the heterogeneous portion is more finely dispersed. Accordingly, in the pitch-based carbon fiber of the present invention having the specific fractal structure, which simultaneously satisfies the requirements of the formulae (3) and (4), concentration of the stress to the heterogeneous portion in the fiber can be effectively avoided, and therefore, the pitch-based carbon fiber of the present invention can resist a large deformation.

The pitch-based carbon fiber of the present invention satisfying the requirements of the formulae (3) and (4) has a strength exceeding 500 kg/mm$^2$ and an elongation exceeding 2.5% in combination, and as shown in the examples given hereinafter, a strength exceeding 600 kg/mm$^2$ and an elongation of about 3% can be simultaneously manifested.

The pitch-based carbon fiber of the present invention having the above-mentioned specific fractal structure has excellent physical properties not expected from not only the conventional pitch-based carbon fibers but also the conventional PAN type carbon fibers.

The process for the preparation of the pitch-based carbon fiber of the present invention will now be described in detail.

Petroleum or coal type pitch is used as the pitch to be spun, which is the starting material of the pitch-based carbon fiber of the present invention. In the process of the present invention, the time of the infusible treatment can be shortened irrespectively of the composition of the pitch, and the effect of improving the physical properties of the carbon fiber after the carbonization treatment can be attained. In order to prepare a high-performance carbon fiber, it is preferred that a pitch in which the occupancy ratio of the optically anisotropic region is at least 50%, especially at least 90%, be used. An optically anisotropic pitch in which the occupancy ratio of the optically anisotropic region is lower than 50% is poor in the spinnability and a homogeneous and stable pitch fiber cannot be prepared, and the physical properties of the obtained carbon fiber are poor.

The occupancy ratio of the optically anisotropic region is measured according to the method disclosed in U.S. Pat. No. 4,628,001.

The melting point of the pitch to be spun is preferably 280° to 340° C., especially preferably 290° to 330° C., as determined by the Mettler method. In the preferred pitch to be spun in the present invention, a higher ratio of the optically anisotropic region (hereinafter referred to as "the optically anisotropic quantity") is preferable, and it is especially preferred that the optically anisotropic quantity be at least 90%. This pitch is homogeneous and excellent in the spinnability.

As the starting material of this pitch to be spun, there can be mentioned coal tar pitch, a coal type heavy oil such as liquefied coal, a normal pressure distillation residual oil of petroleum, a reduced pressure distillation residual oil of petroleum, a tar or pitch obtained as a by-product at the heat treatment of these residual oils, and products obtained by refining petroleum heavy oils such as oil sand and bitumen, and the pitch to be spun can be obtained by treating such starting materials by the combination of a heat treatment, a solvent extraction treatment, a hydrogenation treatment and the like. Particularly preferably, the pitch may be prepared according to the process described in U.S. Pat. No. 4,628,001.

The pitch-based carbon fiber of the present invention can be realized by using a spinning nozzle satisfying the following requirements for melt-spinning the above-mentioned pitch to be spun. More specifically, in a spinning nozzle comprising an introduction hole portion and a fine hole portion, a stationary dividing element and/or a stationary kneading element are arranged upstream of the introduction hole portion, the requirement of the following formula is satisfied in connection with the cross-sectional area S(l) (mm$^2$) of the nozzle hole at a distance l (mm) measured in the direction toward the outlet of the spinning nozzle from the most downstream position of the stationary element and/or stationary kneading element as the origin, the distance lo (mm) between the most downstream point of the stationary dividing element and/or stationary kneading element and the outlet of the nozzle and the viscosity $\eta$ (poise) of the spun pitch in the spinning nozzle:

$$\int_0^{lo} \eta \cdot S(l)^{-\frac{1}{2}} dl < 6 \times 10^4 \quad (5)$$

the requirements of the following formulae are satisfied with respect to the angle (degree) of introduction to the fine hole portion from the introduction hole portion, the length lc (mm) of the fine hole portion and the quantity Q (g/min) of the pitch extruded per hole of the spinning nozzle:

$$150° \leqq \theta \leqq 180° \quad (6)$$

$$lc.\eta/Q > 20 \quad (7)$$

and the pitch to be spun is spun by passing it through the stationary dividing element and/or stationary kneading element and the introduction hole portion and fine hole portion in this order.

The stationary dividing element and/or stationary kneading element means an element through which the molten pitch to be spun is divided into fine streams or kneaded.

Use of the stationary dividing element and/or stationary kneading element for melt spinning is known. As the result of investigations, we found that if the stationary dividing element and/or stationary kneading element is applied to the above-mentioned spinning nozzle, very peculiar effects are manifested. More specifically, when the pitch to be spun passes through the above-mentioned element, the flow is divided by the element and a number of specific points of the orientation in the liquid crystal structure, generally called "disclinations", are formed. It is presumed that the pitch to be spun is composed of flat molecules approximated by a plate-like shape, and the pitch is characterized in that normal erected on the flat planes of the plate-like molecules align parallel to one another in the optically anisotropic phase. The above-mentioned disclinations are points discontinuous with respect to this orientation. What is important is that when the stationary dividing element and/or stationary kneading element is used, no large change is caused in local orientation characteristics, but defects appear in the order of orientation at a long distance and these defects are recognized as disclinations.

The pitch to be spun is characterized in that in the stationary flow field, the normals of the constituent plate-like molecules are oriented perpendicularly to the direction of the velocity gradient and the direction of the flow. For example, in case of the flow in a circular tube, the normals of the constituent plate-like molecules are concentrically arranged in the cross-section of the circular tube. The respective molecules grow two-dimensionally while retaining this arrangement to form a carbonized structure, and this corresponds to a carbon fiber of a so-called radial structure. Namely, the pitch has such a characteristic that in the flow field, an arrangement having a very high symmetry is stabilized. It is considered that this phenomenon corresponds to the flow alignment known in ordinary nematic liquid crystals. Accordingly, the disclinations formed by the stationary dividing or kneading element are extinguished downstream of the element in the nozzle by the effect of the flow field, and finally, the entire orientation is rearranged in the uniform state. Accordingly, if spinning is carried out by passing the pitch to be spun through the stationary dividing element and/or stationary kneading element and the introduction hole portion and fine hole portion of the spinning nozzle in this order, it is necessary to select special conditions. Namely, it is necessary that the spinning nozzle should satisfy the requirements of the above-mentioned formulae (5), (6), and (7).

In case of a circular tube having a certain diameter, the left side member of the formula (5) is proportional to the product of the tube length/tube diameter ratio and the viscosity, and this also is proportional to the product of the shearing stress by the flow in the tube and the residence time of the fluid in the tube. In view of the fact that the cause of the flow alignment is the shearing stress and the transition to the stable structure is a kind of the relaxation process, it is presumed that there is an upper limit in allowable values of the left side member of the formula (5). We found that if the value of the left side member of the formula (5) is smaller than $6\times10^4$, irrespectively of the shape of the tube, disclinations formed by the stationary dividing element and/or stationary kneading element can be effectively maintained. However, in the case where the nozzle hole has a contracted portion, especially in case of a spinning nozzle comprising an introduction hole portion and a fine hole portion, if the angle of introduction to the fine hole portion from the introduction hole is small, the effect of re-arranging the orientation to the uniform state is conspicuous. Accordingly, the angle should be set within the range defined y the formula (6). If the angle $\theta$ of the formula (6) is smaller than 150°, the orientation is rearranged to the uniform state, and no good results are obtained. In order to manifest the fractal structure referred to in the present invention, it is necessary that the angle $\theta$ should be at least 150°, preferably at least 170°.

The selective orientation in the cross-section of the fiber is not particularly necessary for the production of a highly oriented high-modulus carbon fiber, but the selective orientation in the direction of the fiber axis is important. In essence, the flow alignment in the spinning nozzle also is the main factor of the orientation in the direction of the fiber axis. Accordingly, it is indispensable that the average arrangement of the plate-like molecules in the spinning nozzle should be so that the normals of the plate-like molecules are present in the cross-section of the nozzle, and the arrangement in the cross-section of the nozzle should not be uniform. In order to satisfy these requirements simultaneously, it is indispensable that the conditions represented by the formulae (5), (6) and (7) should be simultaneously established. In the case where the fine hole is a circular tube, the left side member of the formula (7) is proportional to the ratio of the tube length/tube diameter ratio to Reynold's number. When this value is small, the effect of inertia is dominant, and the degree of the selective orientation in the direction of the fiber axis becomes insufficient.

In the case where the conditions of the formulae (5), (6) and (7) are not established, the fractal structure referred to in the present invention is not manifested, but the fiber comes to have a mere random structure and high physical properties cannot be obtained.

If the pitch to be spun, in which many disclinations have been formed by the passage through the stationary dividing element and/or stationary kneading element, is passed through the spinning nozzle portion satisfying the requirements of the formulae (5), (6) and (7), the pitch is arranged so that the orientation direction of the local molecule normals is perpendicular to the flow direction of the pitch, while holding the disclinations.

The hole configuration of the spinning nozzle is not particularly critical, so far as the requirements of the formulae (5) through (7) are satisfied, and may be of circular, but if a non-circular spinning nozzle, preferably a slit-like spinning nozzle, which has a spinning hole in which, supposing that the center line distance of the wet edge is Ln and the width of the wet edge is Wn, at least one of Ln satisfies the requirements represented by the following formulae, as disclosed in U.S. Pat. No. 4,628,001, is used, the fractal dimension of the obtained carbon fiber is higher than that of a carbon fiber obtained when a circular nozzle satisfying the requirements of the formulae (5) through (7) is used:

$$Ln < 10 \text{ mm} \quad (8)$$

$$1.0 < Ln/Wn \leqq 20 \quad (9)$$

At the melt-spinning step, it is preferred that the spinning temperature be lower than 360° C., especially a temperature of the melting point of the pitch plus 10° to 50° C. The spinning speed is preferably about 50 to about 1500 m/min.

The so-obtained pitch fiber is subjected to an ordinary stabilization treatment for infusibilizing the fiber in air and is then subjected to a carbonization treatment in an inert atmosphere, whereby a carbon fiber having a high strength can be obtained, as is apparent from the examples given hereinafter. If a specific infusible reaction described hereinafter is carried out and a carbonization is then carried out in an inert atmosphere, the fractal structure referred to in the present invention is more effectively manifested, and a pitch-based carbon fiber or graphite fiber having high strength and high elastic modulus or high strength and high elongation, that cannot be obtained according to the conventional techniques, can be provided. This is another great significance of the present invention.

The specific infusible reaction referred to herein is an infusible reaction using iodine.

For this specific infusible reaction, there can be adopted a process in which iodine is doped in the spun pitch fiber and the pitch fiber is treated in air and then carbonized, and a process in which the pitch fiber is treated in a mixed gas containing oxygen and iodine and is then calcined.

The means for doping iodine in the spun pitch fiber in the former process is not particularly critical, but there can be adopted (a) a method in which the pitch fiber is contacted with a vapor of iodine and (b) a method in which the pitch fiber is coated with a solution containing iodine dissolved or dispersed therein.

These methods (a) and (b) can be conducted simultaneously with melt spinning or they may conducted on the spun and wound pitch fiber.

It is preferred that the amount of iodine contained in the pitch fiber should be at least 1% by weight, more preferably at least 3% by weight.

If the iodine content is lower than 1% by weight, no prominent improving effects are found in the physical properties of the carbonized fiber. The upper limit of the iodine content is not particularly critical, and the effects of the present invention are manifested at an optional concentration in the range of up to the saturation concentration of iodine to the pitch fiber. Furthermore, in the case where the pitch fiber is coated with a solution having iodine dissolved or dispersed therein, even if iodine is present on the surface of the fiber or in spaces in the fiber bundle at a concentration exceeding the saturation condition of iodine to the pitch fiber, no trouble is caused in carrying out the process of the present invention and the aimed effects of the present invention can be attained.

The iodine-doped pitch fiber is treated in air at a temperature lower than 350° C., preferably lower than 300° C. Even if the treatment is carried out at a temperature exceeding 350° C., the physical properties of the carbon fiber after the carbonization are not always degraded. However, since the infusible reaction is advanced in a very short time, the infusible oxidation reaction becomes excessive and the reproducibility of the physical properties is poor. If the reaction is carried out at too low a temperature, the time required for the treatment becomes long. Accordingly, from the viewpoint of treatment efficiency, it is preferred that the reaction be carried out at a temperature higher than 100° C., especially higher than 200° C.

In the case where an iodine vapor is contained in the air used for the infusible treatment in air, the process of the present invention can be carried out especially effectively. The air may contain other components, for example, carbon monoxide, carbon dioxide, nitrogen oxides and hydrocarbons, in addition to iodine.

The pressure is not particularly critical at the infusible treatment in air. At a higher pressure, the treatment time can be shortened.

At this treatment in air, the pitch fiber in which iodine has been doped in advance is subjected to the treatment in air. Even if the amount of iodine contained in the pitch fiber is naturally reduced or substantially lost during or after the treatment in air, the manifestation of the aimed effects of the present invention is not hindered at all.

The latter method is characterized in that the melt-spun pitch fiber is treated in the co-presence of an iodine vapor and oxygen and is then heated in an inert atmosphere to effect carbonization and obtain a pitch-based carbon fiber. Namely, according to this method, the step of rendering the fiber infusible with air, which is indispensable in the conventional processes for the production of pitch-based carbon fibers, becomes substantially unnecessary.

In this method, the concentrations of iodine and oxygen are not particularly critical. However, in order to work the present invention efficiently, it is preferred that the iodine concentration in the mixed gas be at least 0.01 mole % and the oxygen concentration be at least 1 mole %. However, even if the iodine concentration is lower than 0.01 mole % or the oxygen concentration is lower than 1 mole %, only the time required for the treatment is prolonged but the effect of preparing a pitch-based carbon fiber having improved physical properties is not degraded at all. From the economical viewpoint, use of air instead of oxygen gas is advantageous.

The mixed gas may contain other components such as carbon monoxide, carbon dioxide, nitrogen, nitrogen oxides, rare gases and hydrocarbon gases in addition to iodine and oxygen or air.

The temperature to be adopted at the treatment of the pitch fiber with the mixed gas of iodine and oxygen is not particularly critical, but it is preferred that the treatment temperature be 100° to 400° C., especially 200° to 350° C. However, even if the treatment temperature is lower than 100° C., only the time required for the treatment becomes long, and the effect of preparing a pitch-based carbon fiber having improved physical properties is not degraded. The pressure for the treatment is not particularly critical, but under a higher pressure, the effect can be attained more efficiently.

Alternatively, the melt spun pitch fiber may be treated with ozone and thereafter treated in a state that iodine exists, preferably heated in a state that iodine and oxygen exist to be infusibilized. Then, the fiber is carbonized by heating it in an inert atmosphere to obtain the pitch-based carbon fiber according to the present invention.

As the method for the treatment with ozone, there can be adopted a method in which the pitch fiber is treated in a gas mixture of ozone and oxygen or air. The ozone concentration in the gas mixture is not particularly critical, but it is preferred that the concentration is not less than 0.01 mole %. Preferably, the treating temperature is 40° C. to 300° C.

Then, the ozone-treated fiber may be infusibilized in the presence of iodine. For this purpose, there can be adopted a process in which iodine is doped in the fiber and then the fiber is heated in air, and a process in which the fiber is heated in a gas mixture of oxygen and iodine.

These processes for the infusibilization of the ozone-treated pitch fiber can be carried out according to the manner as mentioned above with respect to the infusibilization of the pitch fiber not treated with ozone. Thus, the above-mentioned conditions, including preferable conditions, for the infusibilization of the non-ozone-treated pitch fiber can also be applied to the infusibilization of the ozone-treated pitch fiber.

The pitch fiber rendered infusible by any of the foregoing methods is subsequently calcined at a temperature higher than 1000° C. in an inert atmosphere to effect carbonization, and if necessary, the fiber is then graphitized. A carbonization temperature higher than 1100° C. is preferred, and in order to obtain a Young's modulus of at least 30 T/mm$^2$, it is preferred that the carbonization be carried out at a temperature higher than 1800° C. If a higher Young's modulus is desired, carbonization and graphitization can be carried out at a higher temperature.

The invariant $<\eta^2>$ and correlation length in the carbon fiber depend on the carbonization temperature, and the requirements of the formulae (3) and (4) can be satisfied if an appropriate carbonization temperature is selected for the pitch fiber obtained by the above-mentioned spinning and infusible treatments.

In view of the foregoing, it is preferred that the carbonization temperature be 1300° to 1800° C.

As is apparent from the foregoing description, since the pitch-based carbon fiber has the novel fractal structure as the cross-sectional structure thereof, formation of cracks can be prevented and embrittlement of the fiber by graphitization is controlled, and therefore, a very tough fiber having a high Young's modulus can be provided. Furthermore, if this structural feature is combined with the specific infusible treatment, a pitch-based carbon fiber having a tensile strength higher than 600 kg/mm$^2$, which cannot be attained in the conventional pitch-based carbon fibers, can be obtained, and this high level of the tensile strength can be maintained even if the Young's modulus exceeds 50 T/mm$^2$. More specifically, by slightly changing the preparation conditions, a fiber having a high strength and a high elongation or even a fiber having a strength exceeding 600 kg/mm$^2$ and an elongation of about 3.0% can be obtained, and a fiber having excellent characteristics, not realizable even in the conventional PAN type carbon fibers, can be provided. Moreover, since the effects can be attained irrespectively of the cross-sectional shape of the spinning nozzle, a high strength and high-Young's modulus carbon fiber having an optional cross-sectional shape can be obtained.

If the carbon fiber of the present invention is used as a reinforcing fiber of a composite material, it is expected that not only the strength and modulus but also the impact strength will be improved, and this composite material can be preferably used in various fields.

The methods for measuring the fractal dimension of the carbon fiber and the X-ray small angle scattering, to be adopted in the present invention, will now be described.

METHOD FOR MEASUREMENT OF FRACTAL DIMENSION

The carbon fiber to be measured is heat-treated at 2800° C. in helium and is cut orthogonally to the fiber axis to form a measurement sample. Incidentally, vacuum deposition of a metal is not effected on the sample. The sample is photographed under 30000 magnifications at an acceleration voltage of 5 kV under a scanning electron microscope (resolving power of 7 Å), Model S-900 supplied by Hitachi Seisakusho. From this photograph, the profile of one continuous structural unit is traced to obtain a curve having a definite length. With one end of this curve being as the starting point, a circle having a radius r is drawn with this point being as the center, and a straight line is drawn between the starting point and the point where the circle first intersects the structural unit. The above operation is repeated with the intersection point being as the new starting point, and the number N(r) of segments necessary for approximating the curve, now considered, by segments having a length r is determined. Both of obtained N(r) and r are logarithmically plotted, and the gradient D is determined relatively to r in the range of from E/2.5 to E/25 by the method of least squares. The absolute value of D is designated as the fractal dimension of this structural unit. E is a smallest principal radius of gyration of the cross-section of the fiber, and the outer configuration is determined from the scanning electron microscope photograph and E is calculated from this outer configuration according to the above-mentioned formulae (10) through (14).

At the above operation, the cross-section of the fiber is divided into 5 portions having an equal area, and five structural units are randomly sampled. The mean values of the fractal dimensions of the respective structural units is calculated as the fractal dimension D of the carbon fiber. The shapes of the respective portions formed by dividing the cross-section of the fiber are optional, but they should not contain a discontinuous (non-connected) part.

METHOD FOR MEASUREMENT OF X-RAY SMALL ANGLE SCATTERING

System RAD-B supplied by Rigaku Denki is used for the measurement of the X-ray small angle scattering, and a position sensitive proportional counter (PSPC) is used as the detector. The incident X-ray is monochromated by a graphite monochromator, converged by a pinhole slit having a diameter of 0.15 mm and applied to the sample. The Quantity of the fiber bundle is adjusted so that the absorption of the X-ray is about 50%, and the fiber sample is fixed to a frame and set at a goniometer. The incident intensity is obtained by measuring the total counting values in the state of not setting the fiber sample at the goniometer, using a filter in which the X-ray transmission is known. The X-ray transmission of the fiber is determined by inserting the sample in a path of the incident ray and actually measuring the intensity of the transmitted ray. The average thickness of the fiber bundle is calculated from the X-ray transmission measured above, the value of the mass absorption coefficient of carbon shown in literature references and the density of the fiber. The distance between the sample and the detector is adjusted, and a height-restricting slit is not attached to PSPC and the measurement is performed at least over the range of $2\theta=0°$ to 4°.

The X-ray beam is incident on the fiber sample perpendicularly thereto, and the direction perpendicular to both of the fiber axis and the X-ray beam is designated as the x axis, and the point of intersection between the x axis and the incident X-ray beam is designated as the origin. The X-ray scattering intensity is scanned in the direction parallel to the x axis. $I(x)^{-2/3}$ in which I(x) stands for the scattering intensity at a certain point x is plotted relatively to $x^2$. At this time, an approximate straight line is obtained in the region where x is large. This line satisfies the requirement of the following formula:

$$I(x)^{-2/3} = K^{-2/3}\left(\frac{\lambda D}{2\pi ac}\right)^{4/3}\cdot\left[1+\left(\frac{2\pi ac}{\lambda D}\right)^2 x^2\right] \quad (15)$$

wherein D stands for the distance between the sample and the detector, and λ stands for the wavelength of the incident X-ray. From the segment and gradient of the approximate straight line, K and ac are determined by using the above formula. The following relation is established between K and $<\eta^2>$, and $<\eta^2>$ is determined from this relation:

$$<\eta^2> = \frac{2\pi m^2 c^4}{e^4 \lambda^3 DtAI_0} K \quad (16)$$

wherein m stands for the mass of electron, c stands for the velocity of light, e stands for the quantum of electricity, AIo stands for the intensity of incident radiation, t stands for the thickness of the fiber bundle, and λ and D are as defined above. The present invention will now be described in detail with reference to the following non-limitative examples. Incidentally, the strength, elongation and Young's modulus of carbon fibers referred to in the instant specification are those determined according to the methods of JIS R-7061.

EXAMPLE 1

A spinning pitch having an optically anisotropic region occupancy ratio of 92%, a quinoline-insoluble content of 35.4% and a melting point of 305° C. determined by the Mettler method was prepared from commercially available coal tar pitch according to the process disclosed in Japanese Unexamined Patent Publication No. 59-53717, corresponding to U.K. Patent GB 2129825A.

The spinning pitch was charged in a metering feeder provided with a heater, and the pitch was melted, deaerated and then spun by using a spinneret having a spinning fine hole consisting of a single slit having a width of 60 microns and a center line distance of 540 microns, in which a stationary kneading element comprising 12 twisted elements having a twisting angle of about 180°, which were piled so that the twisting directions were opposite to one another, was arranged upstream of a spinning nozzle. The diameter of the induction hole was 2 mm, the length of the fine hole portion was 0.6 mm, and the distance between the most downstream part of the stationary kneading element and the outlet of the nozzle was 4 mm. The introduction angle of the nozzle was 180°. The extrusion quantity from the feeder was 0.021 g/min/hole, the spinneret temperature was 335°C., and the spun fiber was wound at a take-up rate of 600 m/min. The viscosity of the spinning pitch at the spinneret temperature was 500 poise.

The pitch fiber was heated in air while elevating the temperature from 200° C. to 300° C. at a rate of 10° C., and the fiber was maintained at 300° C. for 30 minutes. Then, in a nitrogen atmosphere, the temperature was elevated to 1300° C. at a rate of 500° C./minute, and the pitch fiber was carbonized by maintaining the pitch fiber at 1300° C. for 1 minute to obtain a carbon fiber.

When the physical properties of this carbon fiber were determined, it was found that the strength was 605 kg/mm$^2$, the elongation was 2.3% and the Young's modulus was 26 T/mm$^2$. Thus, it was confirmed that a high-tenacity carbon fiber was obtained.

This carbon fiber was graphitized at 2400° C. in a helium atmosphere. The graphitized fiber had a strength of 595 kg/mm$^2$, an elongation of 1.2% and a Young's modulus of 52 T/mm$^2$. Thus, it was confirmed that the fiber had a high strength and a high elastic modulus.

When the cross-section of this carbon fiber was observed by a scanning electron microscope having a resolving power of 7 Å, it was found that the value E was 1.2 microns and the fractal dimension of the structural units in the range of from 0.48 micron to 0.048 micron was 1.18.

EXAMPLE 2

The pitch fiber obtained in Example 1 was heat-treated in an air/iodine mixed gas containing 0.5 mole % of iodine while elevating the temperature from room temperature to 225° C. at a rate of 2.5° C./min, and the fiber was maintained at 225° C. for 2 hours.

Then, the fiber was carbonized in a nitrogen atmosphere while elevating the temperature to 1300° C. at a rate of 500° C./min.

When the physical properties of the obtained carbon fiber were measured, it was found that the strength was 690 kg/mm$^2$, the elongation was 3.0% and the Young's modulus was 23 T/mm$^2$. Thus, it was confirmed that the carbon fiber had a high strength and a high elongation.

The invariant of this carbon fiber was 0.04 mole electron$^2$cm$^6$, and the correlation length was 4 Å.

This carbon fiber was graphitized in a helium atmosphere at 2950° C.

When the physical properties of the carbon fiber after the graphitization were measured, it was confirmed that the strength was 685 kg/mm$^2$, the elongation was 0.9% and the Young's modulus was 72 T/mm$^2$. Thus, it was confirmed that the fiber had a high strength and a high elastic modulus.

The results of the observation of the cross-section of this carbon fiber by a scanning electron microscope having a resolving power of 7 Å are shown in FIG. 1. The value E of the carbon fiber was 1.2 microns, and the fractal dimension of the structural units in the range of from 0.48 micron to 0.048 micron was 1.22.

EXAMPLE 3

A pitch fiber was obtained in the same manner as described in Example 1. This pitch fiber was maintained in an iodine vapor at 100° C. for 5 minutes to make iodine absorbed in the fiber. The iodine content in the pitch fiber was 50 parts by weight per 100 parts by weight of the pitch. The iodine-containing pitch fiber was heated in air by elevating the temperature from room temperature to 225° C. at a rate of 2.5° C./min, and the fiber was maintained at 225° C. for 2 hours.

Then, the pitch fiber was carbonized in a nitrogen atmosphere by elevating the temperature to 1300° C. at a rate of 500° C./min, and the fiber was treated at 2400° C. in helium. In this carbon fiber, the value E was 1.2 microns, and the fractal dimension of the structural units in the range of from 0.48 micron to 0.048 micron was 1.15. When the physical properties of the carbon fiber were measured, it was found that the fiber had such excellent properties as a strength of 665 kg/mm$^2$, an elongation of 1.3% and a Young's modulus of 52 T/mm$^2$.

EXAMPLE 4

A spinning pitch having an optically anisotropic region occupancy ratio of 98%, a quinoline-insoluble content of 27.4% and a melting point of 306° C. determined by the Mettler method was prepared from commercially available coal tar pitch according to the process disclosed in Japanese Unexamined Patent Publication No. 59-53717.

The spinning pitch was melted, deaerated and charged in a metering feeder provided with a heater, and the pitch was passed through a distributor plate zone and spun by using a spinneret having a spinning fine hole consisting of a single slit having a slit width of 60 microns and a central line distance of 540 microns. The other sizes of the spinning nozzle were the same as in Example 1. The quantity of extrusion from the feeder was 0.021 g/min/hole, the spinneret temperature was 335° C., and the spun fiber was wound at a take-up speed of 600 m/min.

The distributor plate used was one shown in FIG. 2(g) of Japanese Patent Publication No. 61-113827.

In this distributor plate, the thickness of the partition plate la was 0.5 mm and the through hole length was 40 mm.

The obtained pitch fiber was heated in an iodine/air mixed gas containing 0.5 mole % of iodine while elevating the temperature from room temperature to 225° C. at a rate of 2.5° C./min, and the pitch fiber was maintained at 225° C. for 2 hours. Then, the pitch fiber was heated in a nitrogen atmosphere while elevating the temperature to 1300° C. at a rate of 500° C., whereby the pitch fiber was carbonized to obtain a carbon fiber.

When the physical properties of the carbon fiber were measured, it was found that the strength was 650 kg/mm$^2$, the elongation was 2.8% and the Young's modulus was 23 T/mm$^2$. Thus, it was confirmed that the carbon fiber had a high strength and a high elongation. The invariant of the carbon fiber was 0.06 mole electron$^2$/cm$^6$ and the correlation length was 7 Å.

This carbon fiber was graphitized in a helium atmosphere at 2950° C. When the physical properties of the carbon fiber after the graphitization were measured, it was found that the strength was 651 kg/mm$^2$, the elongation was 0.9% and the Young's modulus was 70 T/mm$^2$. Thus, it was confirmed that the fiber had a high strength and a high elastic modulus.

When the cross-section of this carbon fiber was observed by a scanning electron microscope having a resolving power of 7 Å, it was found that the value E was 1.2 microns and the fractal dimension of the structural units in the range of from 0.48 to 0.048 micron was 1.15.

EXAMPLE 5

A carbon fiber was prepared in Example 2 except that the shape of the spinning fine hole was of a true circle having a diameter of 0.2 mm, the diameter of the introduction hole was 2 mm, the length of the fine hole portion was 0.2 mm, the distance between the most downstream end of the stationary kneading element and the outlet of the nozzle was 3 mm, and the carbonization of the second stage at 2950° C. was not carried out. In the obtained carbon fiber, the value E of the cross-section of the fiber was 1.8 microns, and the fractal dimension of the structural units in the range of from 0.72 micron to 0.072 micron was 1.21. When the physical properties of this carbon fiber were measured, it was found that the strength was 551 kg/mm$^2$, the elongation was 2.5% and the Young's modulus was 22 T/mm$^2$.

The fiber was then heated in helium at 2000° C. The obtained fiber had a strength of 648 kg/mm$^2$, a Young's modulus of 35 T/mm$^2$ and an elongation of 1.9%.

The invariant of this carbon fiber was 0.05 mole electron$^2$/cm$^6$, and the correlation length was 6 Å.

COMPARATIVE EXAMPLE 1

A pitch fiber was obtained in the same manner as described in Example 5 except that the stationary kneading element was not used. In the same manner as described in Example 1, this pitch fiber was heat-treated in air and then in a nitrogen atmosphere at 1300° C. at the highest and at 2000° C. in helium to obtain a carbon fiber. The value E of the cross-section of the fiber was 1.8 microns and the fractal dimension of the structural units in the range of from 0.72 micron to 0.072 micron was 1.00. Cracks were present in this carbon fiber, and when the physical properties of the carbon fiber were measured, it was found that the strength was 210 kg/mm$^2$, the elongation was 0.7% and the Young's modulus was 30 T/mm$^2$.

EXAMPLE 6

A pitch fiber was obtained in the same manner as described in Example 1. This pitch fiber was maintained in air containing 1.5 mole % of ozone at 150° C. for 30 minutes to be reacted with ozone. The ozone-treated fiber was heated in air containing 0.5 mole % of an iodine vapor by elevating the temperature from room temperature to 225° C. at a rate of 2.5° C./min, and the fiber was maintained at 225° C. for 30 minutes.

Then, the pitch fiber was carbonized in a nitrogen atmosphere by elevating the temperature to 1300° C. at a rate of 500° C./min. The measurement of the physical properties of the carbon fiber proved that the fiber had such excellent properties as a strength of 695 kg/mm$^2$, a Young's modulus of 24 T/mm$^2$ and an elongation of 2.9%.

The carbon fiber was then graphitized in helium at 2950° C. When the cross-section of this carbon fiber was observed by a scanning electron microscope having a resolving power of 7 Å it was found that the value E of the fiber was 1.2 microns and the fractal dimension of the structural units in the range of from 0.48 micron to 0.048 micron was 1.18. The measurement of the physical properties of the graphitized carbon fiber proved that the fiber had such excellent properties as a strength of 702 kg/mm$^2$, a Young's modulus of 73 T/mm$^2$ and an elongation of 1.0%.

EXAMPLE 7

A pitch fiber was obtained in the same manners described in Example 1 except that the take-up rate wa 60 m/min. This pitch fiber was maintained in air containing 1.5 mole % of ozone at 225° C. for 2 hours to be reacted with ozone. The ozone-treated fiber was heated in air containing 2 mole % of an iodine vapor by elevating the temperature from room temperature to 300° C. at a rate of 2.5° C./min, and the fiber was maintained at 300° C. for 2 hours.

Then, the pitch fiber was carbonized in a nitrogen atmosphere by elevating the temperature to 1300° C. at a rate of 500° C./min. The carbon fiber was then graphitized in helium at 2600° C. The measurement of the physical properties of the graphitized carbon fiber proved that the fiber had such excellent properties as a strength of 501 kg/mm$^2$, a Young's modulus of 52 T/mm$^2$ and an elongation of 1.0%. The cross-sectional area of the graphitized carbon fiber was 302 $\mu m^2$ as measured by using a scanning type electron microscope.

What is claimed is:

1. A pitch-based carbon fiber having a microstructure consisting of strip-like structural units extended in the longitudinal direction of the fiber, wherein the fractal dimension D of the arrangement of the strip-like structural units in the cross-section of the fiber has a fractal structure satisfying the requirement of the following formula (2) relatively to the observation scale r satisfying the requirement of the following formula (1) with respect to the cross-section of the fiber:

$$E/2.5 > r > E/25 \quad (1)$$

$$2.0 > D > 1.05 \quad (2)$$

wherein E in the formula (1) stands for a smallest principal radius of gyration of cross-sectioned area of the fiber.

2. A pitch-based carbon fiber as set forth in claim 1, wherein the tensile strength is at least 500 kg/mm$^2$ and the Young's modulus is at least 30 T/mm$^2$.

3. A pitch-based carbon fiber as set forth in claim 2, wherein the tensile strength is at least 600 kg/mm$^2$ and the Young's modulus is at least 50 T/mm$^2$.

4. A pitch-based carbon fiber as set forth in claim 1, wherein the invariant $<\eta^2>$ and correlation length ac, determined by the X-ray small angle scattering intensity measurement, satisfy the requirements of the following two formulae:

$$<\eta^2> < 0.1 \text{ mole electron}^2/\text{cm}^6 \quad (3)$$

$$a_c < 10 \text{ Å} \quad (4)$$

5. A pitch-based carbon fiber as set forth in claim 4, wherein the tensile strength is at least 500 kg/mm$^2$ and the elongation is at least 2.5%.

6. A pitch-based carbon fiber as set forth in claim 5 wherein the tensile strength is at least 600 kg/mm$^2$ and the elongation is about 3%.

* * * * *